US005799707A

United States Patent [19]

Barrett et al.

[11] Patent Number: 5,799,707

[45] Date of Patent: Sep. 1, 1998

[54] SINGLE LAYER PAPERMAKERS FORMING FABRIC

[75] Inventors: Rex Barrett, Peachtree City, Ga.; Robert A. Wilkes, Sarsfield, Canada

[73] Assignee: JWI Ltd., Kanata, Canada

[21] Appl. No.: 822,752

[22] Filed: Mar. 24, 1997

[51] Int. Cl.[6] ..... D03D 13/00

[52] U.S. Cl. ..... 139/383 A

[58] Field of Search ..... 139/383 AA; 442/203; 162/903

[56] References Cited

U.S. PATENT DOCUMENTS

| | | | |
|---|---|---|---|
| Re. 33,195 | 4/1990 | McDonald et al. . | |
| 4,423,755 | 1/1984 | Thompson | 139/383 A |
| 4,529,013 | 7/1985 | Miller . | |
| 4,989,647 | 2/1991 | Marchand . | |
| 4,989,648 | 2/1991 | Tate et al. | 139/383 A |
| 4,995,428 | 2/1991 | Tate et al. | 139/383 A |
| 4,998,569 | 3/1991 | Tate | 139/383 A |
| 5,158,118 | 10/1992 | Tate et al. | 139/383 A |
| 5,456,293 | 10/1995 | Ostermayer et al. | 139/383 A |
| 5,520,225 | 5/1996 | Quigley et al. | 139/383 A |
| 5,542,455 | 8/1996 | Ostermayer et al. | 139/383 A |

*Primary Examiner*—Andy Falik

*Attorney, Agent, or Firm*—Robert A. Wilkes

[57] ABSTRACT

A single layer papermaking machine forming fabric which is woven from a single layer of warps interlaced with primary wefts, secondary wefts, and, if desired, tertiary wefts. The secondary and tertiary wefts are located between the primary wefts. The fabric is woven in a first pattern which repeats once in N sheds, and N is at least 10. The primary, secondary, and, if present, tertiary weft are woven to second, third, and, if present, fourth patterns in a lower number of sheds and which repeat at least twice within the first pattern. This weave provides a forming fabric having good first pass retention, good drainage properties, reduced wire mark, good fabric height and good release characteristics. In certain pattern combinations a forming fabric can be woven exhibiting a level of visual discontinuity or randomness in the paper side face.

30 Claims, 8 Drawing Sheets

SINGLE LAYER PAPERMAKERS FORMING FABRIC

BACKGROUND TO THE INVENTION

This invention relates to a single layer papermaker's forming fabric, for use in the forming section of a papermaking machine.

In either a single fabric or twin fabric paper making machine the initial step in making paper is to deposit an aqueous stock, which includes both fibres from which the paper web is formed, and other solids such as fillers and pigments, onto a moving forming fabric, in the forming section of the paper making machine. As the stock on the forming fabric moves through the forming section a proportion of the water in the stock is removed through the forming fabric, by drainage devices disposed in contact with the forming fabric. Initially the stock will generally contain in excess of 97% water; at the end of the forming section the incipient paper web generally contains from about 80% to about 85% water. This remaining water is removed in the press and dryer sections of the papermaking machine, which follow immediately after the forming section, to provide the desired paper.

Once the incipient paper web leaves the forming section it is extremely difficult, if not effectively impossible, to deal with any flaws in it: what goes on in the stock on the forming fabric to convert a substantially three dimensional array of fibres and other solids into an essentially two dimensional very wet paper web is therefore of vital importance to the quality and acceptability of the final paper product. It therefore follows that the forming fabric should have a number of desirable characteristics which are to a degree mutually incompatible. The fabric must be capable of withstanding the mechanical and abrasive stresses imposed upon it, which, in modern papermaking machines where the forming fabric moves at a speed in excess of 70 kph, are substantial. The fabric must also be capable of producing acceptable quality paper: the fabric should not cause marking—so-called wire mark—on the machine side of the paper, and the percentage of the paper solids in the stock retained in the paper web—so-called first pass retention—should be as high as possible. In order to achieve a high first pass retention the fabric needs to have good drainage characteristics and low water carrying properties, so that the removed water is readily transported through the fabric and into the drainage devices.

These desiderata to a degree are mutually incompatible. A high drainage rate calls for a fabric with an open weave, but an open fabric causes wire mark. On the other hand a closely woven fabric supports the incipient paper web better, produces little wire mark and gives good first pass retention, but drains relatively poorly.

The drainage behaviour of the fabric, which is largely governed by the weave used in its construction, also has another indirect impact. If the fabric is very open, the incipient paper web tends to be formed somewhat in, rather than just upon, the forming fabric paper side surface. If the fabric is very closely woven, the incipient paper web tends to be formed on, rather than somewhat in, the forming fabric paper side surface. In other words, the "height" in the forming fabric at which the paper web is formed is not the same: the higher the plane of formation, the easier it is to release the incipient paper web from the forming fabric at the end of the forming section and transfer it to the press section. The paper web transferred to the press section is barely self supporting and difficult to handle.

In a single layer forming fabric, the weave pattern uses generally one set of warps, which lie essentially in a single plane in the fabric, and either a single set of wefts which are about the same size as the warps, or two sets of wefts, in which the primary wefts are again about the same size as the warps, and the secondary wefts are either about the same size as the primary wefts, or are of smaller size. The primary and secondary wefts are not woven to the same pattern, the intent being to locate the secondary wefts in such a way that they provide support for the incipient paper web, and so that the gaps formed in the fabric around the knuckles where the primary weft and the warps interlace are filled up, thereby seeking to improve first pass retention and to decrease wire mark. A single layer fabric of this type is described by Tate et al, in U.S. Pat. No. 4,989,648, U.S. Pat. No. 4,995,428, U.S. Pat. No. 4,998,569 and U.S. Pat. No. 5,158,118, and by Thompson, in U.S. 4,423,755.

These forming fabrics have been found not to be completely satisfactory: the manner in which the primary and secondary wefts are required to interlace with the warps places severe constraints on the weave patterns that can be used for the paper side surface of the forming fabric. Further, fabrics of this type appear to suffer from having a high "frame length", which refers to the open areas between adjacent wefts. Whilst a relatively high frame length might improve drainage properties, a high frame length also implies lowered first pass retention.

SUMMARY OF THE INVENTION

This invention seeks to provide a single layer papermaker's forming fabric which overcomes these problems, and provides a fabric with good first pass retention, low wire mark, good drainage properties coupled with low water carriage by the fabric, and improved release of the incipient paper web from the forming fabric surface thus facilitating transfer to the press section. Further, the fabrics of this invention avoid the limitations on paper side surface weave patterns imposed by the known designs.

Until recently all forming fabrics, of both single layer and double layer construction, used a weave that provided a uniform paper side surface: this was believed to be necessary in order to minimise wire mark. It is now known that this is not so, and that at least for certain paper grades a forming fabric which, although still woven to a repeat pattern, displays on its paper side surface a level of visual discontinuity, of apparent randomness, is desirable. Double layer forming fabrics with this feature have been described; this invention makes it possible to weave single layer fabrics with this feature.

Thus in a first broad embodiment this invention seeks to provide a single layer woven papermaker's forming fabric having a machine side and a paper side, comprising warp yarns interlacing with both primary weft yarns and secondary weft yarns in which:

(i) the single layer fabric is woven according to a first pattern that repeats once in N sheds, (ii) the primary weft yarns are woven with the warp yarns according to a second pattern that repeats in A sheds, (iii) one secondary weft yarn is located between any two primary weft yarns, and (iv) the secondary weft yarns are woven with the warp yarns according to a third pattern that repeats in C sheds; wherein:

(a) the second pattern provides at least one machine side cross machine direction exposed primary weft float having a float length Z of at least 2, and A is at least Z+1, (b) the second pattern repeats B times within the N sheds of the first pattern, (c) the third pattern repeats D times within the N sheds of the first pattern, (d) the number of sheds N in the first repeat pattern is at least 10, (e) B and D are different, (f) both B and D are at least 2, and (g) the following relationship exists between A, B, C, D and N: $A \times B = C \times D = N$.

It is also known that when secondary wefts are used, it is possible to include more than one additional weft between each pair of adjacent primary weft: the fabric can include primary, secondary and tertiary wefts.

Consequently, in a second broad embodiment this invention seeks to provide a single layer woven papermaker's forming fabric having a machine side and a paper side, comprising warp yarns interlacing with both primary weft yarns, secondary weft yarns and tertiary weft yarns in which:

(i) the single layer fabric is woven according a first pattern that repeats once in N sheds, (ii) the primary weft yarns are woven with the warp yarns according to a second pattern that repeats in A sheds, (iii) one secondary weft yarn is located between any two primary weft yarns, (iv) the secondary weft yarns are woven with the warp yarns according to a third pattern that repeats in C sheds, (v) one tertiary weft yarn is located between any chosen pairs of primary weft yarns, (vi) the tertiary weft yarns are woven with the warp yarns according to a fourth pattern that repeats in E sheds, and (vii) the location of the tertiary weft yarns repeats within each repeat of the first pattern;

wherein:

(a) the second pattern provides at least one machine side cross machine direction exposed primary weft float having a float length Z of at least 2, and A is at least Z+1, (b) the second pattern repeats B times within the N sheds of the first pattern, (c) the third pattern repeats D times within the N sheds of the first pattern, (d) the fourth pattern repeats F times within the N sheds of the first pattern, (e) the number of sheds N in the first pattern is at least 10, (f) B is not the same as at least one of D and F, (g) B, D and F are at least 2, and (h) the following relationship exists between A, B, C, D, E, F and N: $A \times B = C \times D = E \times F = N$.

Preferably N is at least 12, and more preferably is a higher number still, such as 15, and can be any appropriate value from at least 10 to about 50.

Preferably, $A=(Z+1)$. Preferably, the second pattern includes only one exposed machine side primary weft float.

Preferably, Z has a value in the range 2–10.

Preferably, the secondary weft yarns are smaller than the primary weft yarns.

Preferably, the tertiary weft yarns are smaller than the primary weft yarns. More preferably, when present, the tertiary weft yarns are the same size as the secondary weft yarns.

Preferably, there is both a secondary weft yarn and a tertiary weft yarn between each pair of primary weft yarns.

Alternatively there is one secondary weft yarn between some pairs of weft yarns, and both a secondary weft yarn and a tertiary weft yarn between the remainder of the pairs of primary weft yarns, and the sequence of secondary weft yarns and tertiary weft yarns repeats within the first repeating pattern.

The possible choices for the values for A, B, C, D, E and F are quite broad, and in one sense are only limited by the number of sheds to be used, that is the value of N.

Due to the requirement for an exposed machine side float in the primary weft, A must be 3 or higher. This implies that unless N is large, B will generally be small, and often will be 2, although it is not limited to this value. In order to provide the required float length A will generally equal Z+1; if N is large enough however, A can equal Z+2, or even Z+3. Whilst Z must be at least 2, the upper limit for Z is determined by the stability of the exposed machine side float. If Z is made too high float stability can be lost. Current single layer forming fabric weave designs appear to imply a maximum value for Z of about 10.

Conversely, since it is the secondary weft, together with the tertiary weft if present, that provide a significant proportion of the paper side surface support for the incipient web, a relatively close weave will generally be used for the secondary and tertiary wefts, such as a twill, a broken twill, or a 2×2 basket weave. From this it follows that C and E will generally be small, and typically 2, 3 or 4, whilst D and F will generally be higher. The inter-relationships between these six numbers however are determined to some extent by whether, or not, there is any tertiary weft present. In the simplest case, the secondary and tertiary weft are both woven to the same pattern: that is, the third and fourth patterns are the same, from which it follows that C=E and D=F. But if the third and fourth patterns are not the same, different considerations apply to the possible values for E and F. It should also be noted that when the third and fourth weave patterns are not the same they are often interchangeable, provided that the numerical relationships are obeyed.

When there are no tertiary weft present, or when the third and fourth patterns are the same, in many weave patterns B and C will be the same, and so also will be A and D, for example as follows: $7 \times 2 = 2 \times 7 = 14$. It also follows that certain values for N are excluded, as the relationships cannot be met: an instance of this is N=13, because 13 is a prime number.

When there are tertiary weft present and the third and fourth patterns are not the same, then other constraints apply. For the overall pattern to repeat once in the total of N sheds, then at least one of the two following relationships must provide such a pattern: $A \times B = C \times D = N$, and $A \times B = E \times F = N$. For example, a paring such as $6 \times 2 = 4 \times 3 = 2 \times 6 = 12$ is acceptable, because although the $6 \times 2 = 2 \times 6$ pattern will repeat at shed #6, and therefore the second and fourth patterns reduce to $6 \times 1 = 2 \times 3$, the relationship between the second and third patterns is $6 \times 2 = 4 \times 3$, which repeats in 12 sheds, and therefore the first pattern repeats in 12 sheds. The same logic also applies to a pairing such as $6 \times 2 = 4 \times 3 = 6 \times 2$, in which B and E are the same, and the second and fourth patterns repeat in 6 sheds. As noted above, this logic will also apply if the third and fourth patterns are interchanged, so that it is the second and third patterns which provide the N shed repeat. This provides a hitherto unknown level of flexibility in choosing a second pattern that gives an adequate float length, combined with third and fourth patterns that give minimal wire mark and provide adequate support for the incipient paper web.

DESCRIPTION OF SPECIFIC EMBODIMENTS

In this invention certain terms have particular meanings:

"float length" refers to the number of yarns in one direction which a yarn in the other direction passes over without interlacing with them: thus a weft yarn with a float length of 4 passes over 4 warps without interlacing with them;

"machine direction" refers to a direction essentially parallel to the direction in which the forming fabric moves in the forming section, and the associated term "cross machine direction" refers to a direction essentially perpendicular to the machine direction;

"paper side" and the associated term "paper side surface" refer to the side of the forming fabric which receives the stock;

"machine side" and the associated term "machine side surface" refer to the side of the forming fabric which is supported by the forming section drainage devices; and "yarn profile" refers to the path a yarn follows in either the machine direction or the cross machine direction, and a "yarn profile diagram" is the equivalent of a cross section of a fabric in the machine, or cross machine, direction.

Figure 1:
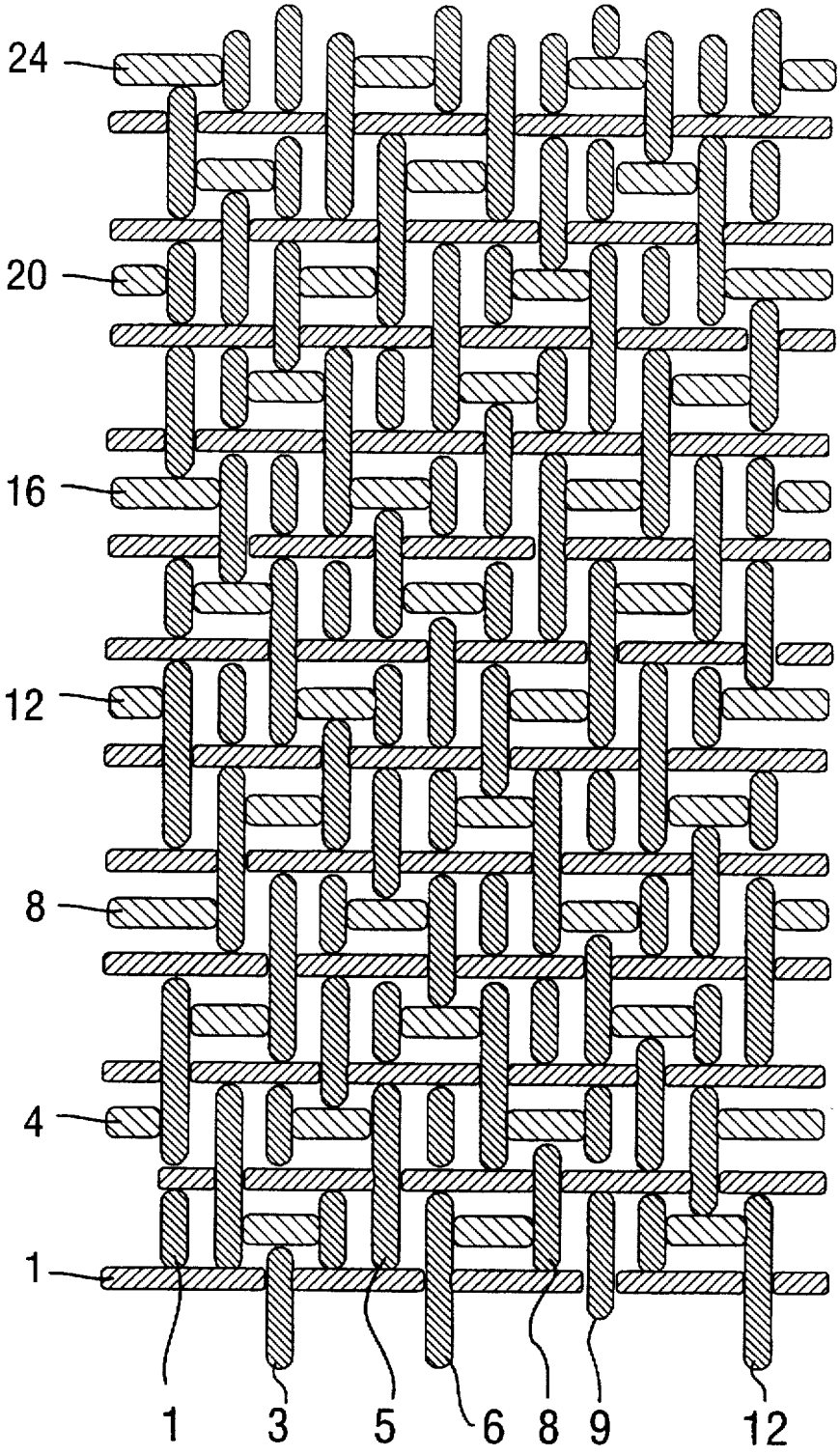
FIG. 1 shows the paper side face of a 12 shed weave.
Figure 5:
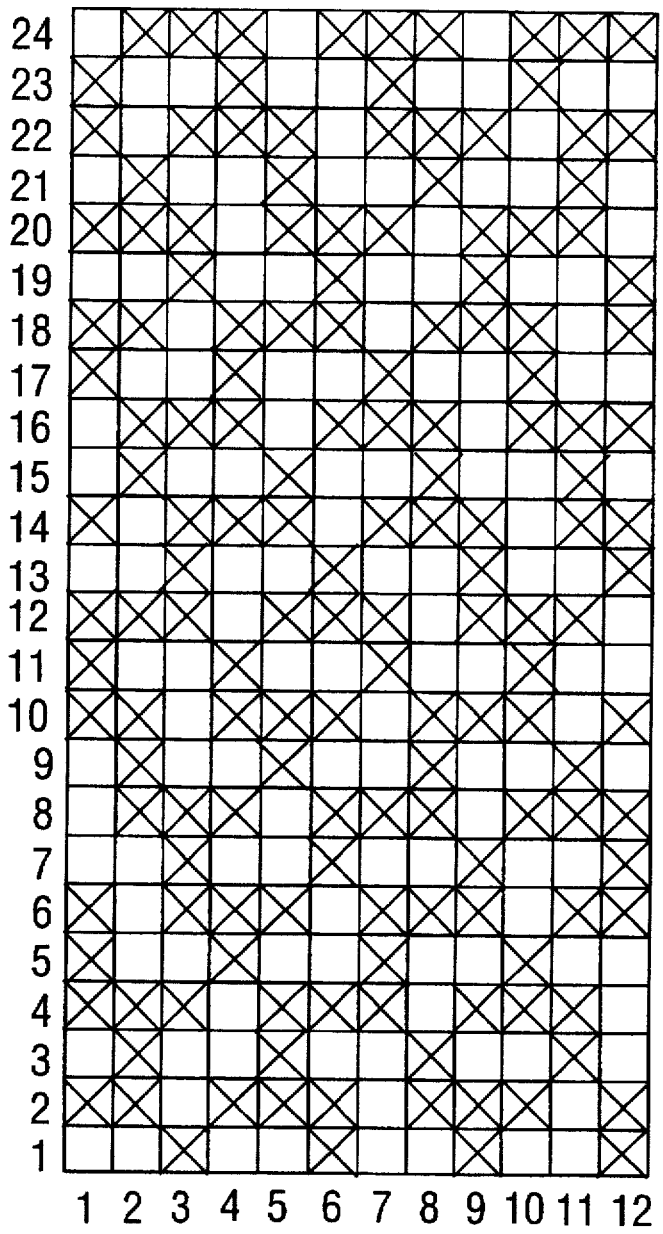
FIG. 5 shows the weave diagram for the fabric of FIG. 1.
Figure 6:
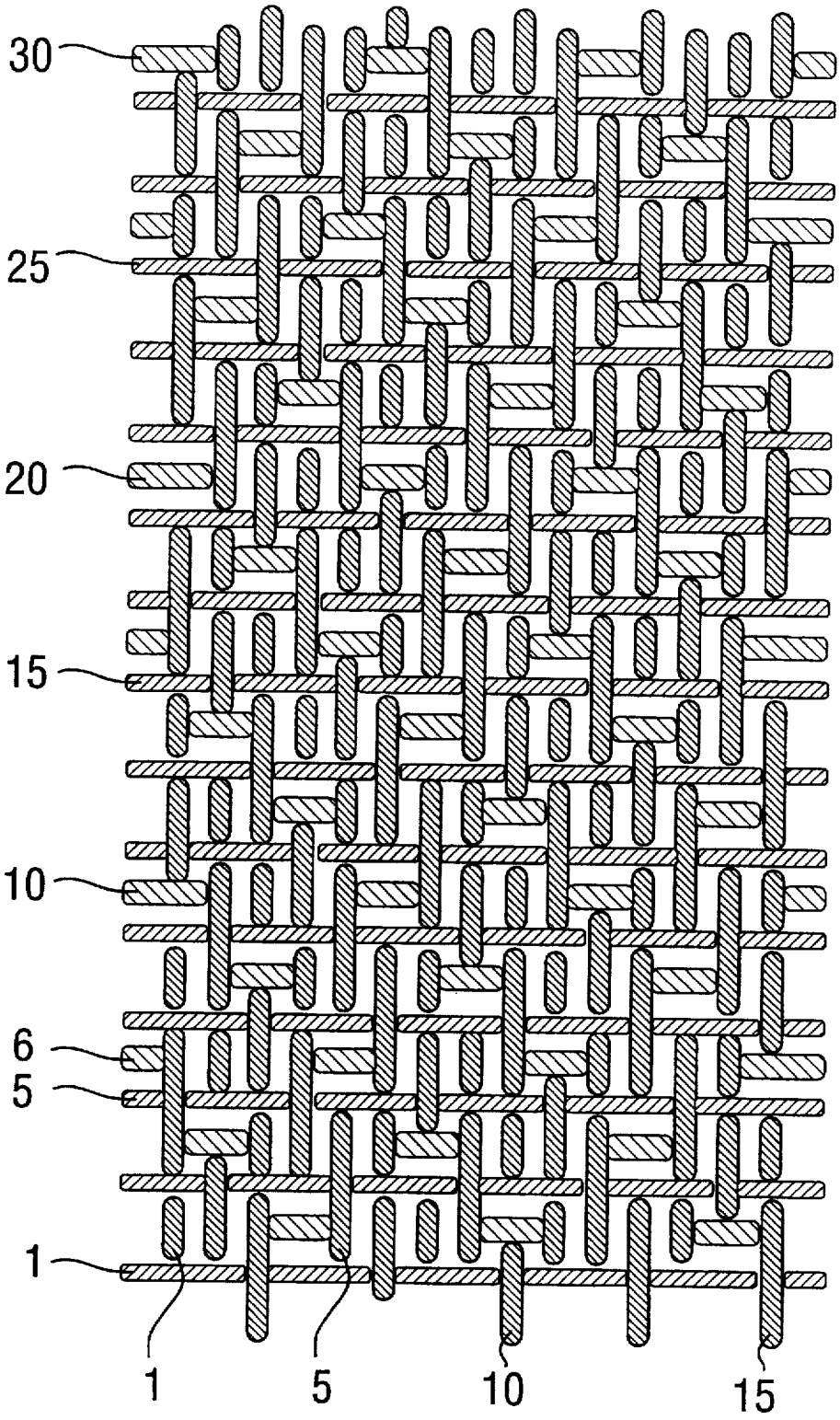
FIG. 6 shows the paper side face of a 15 shed weave.
Figure 10:
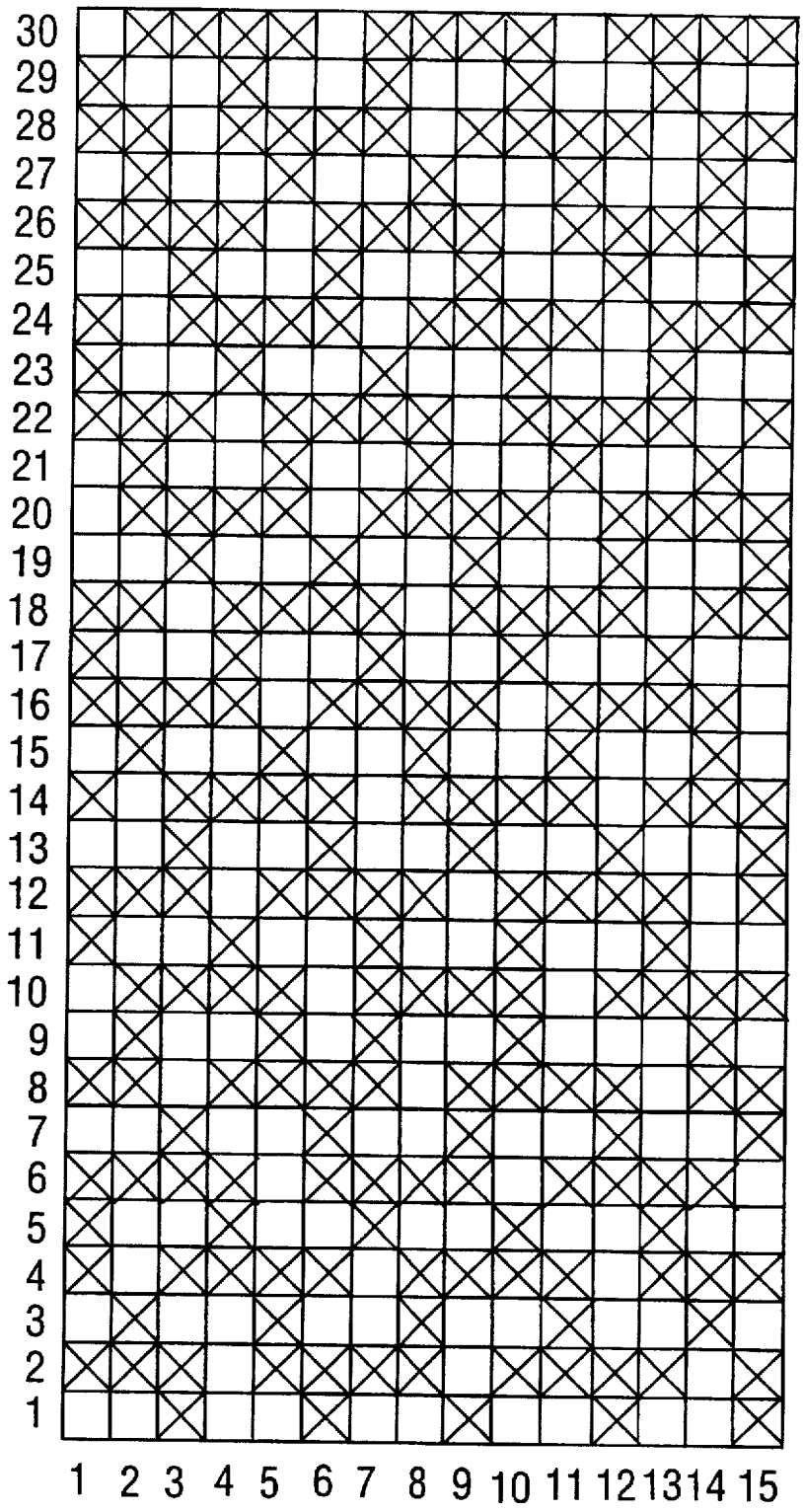
FIG. 10 shows the weave diagram for the fabric of FIG. 6.
Figure 11:
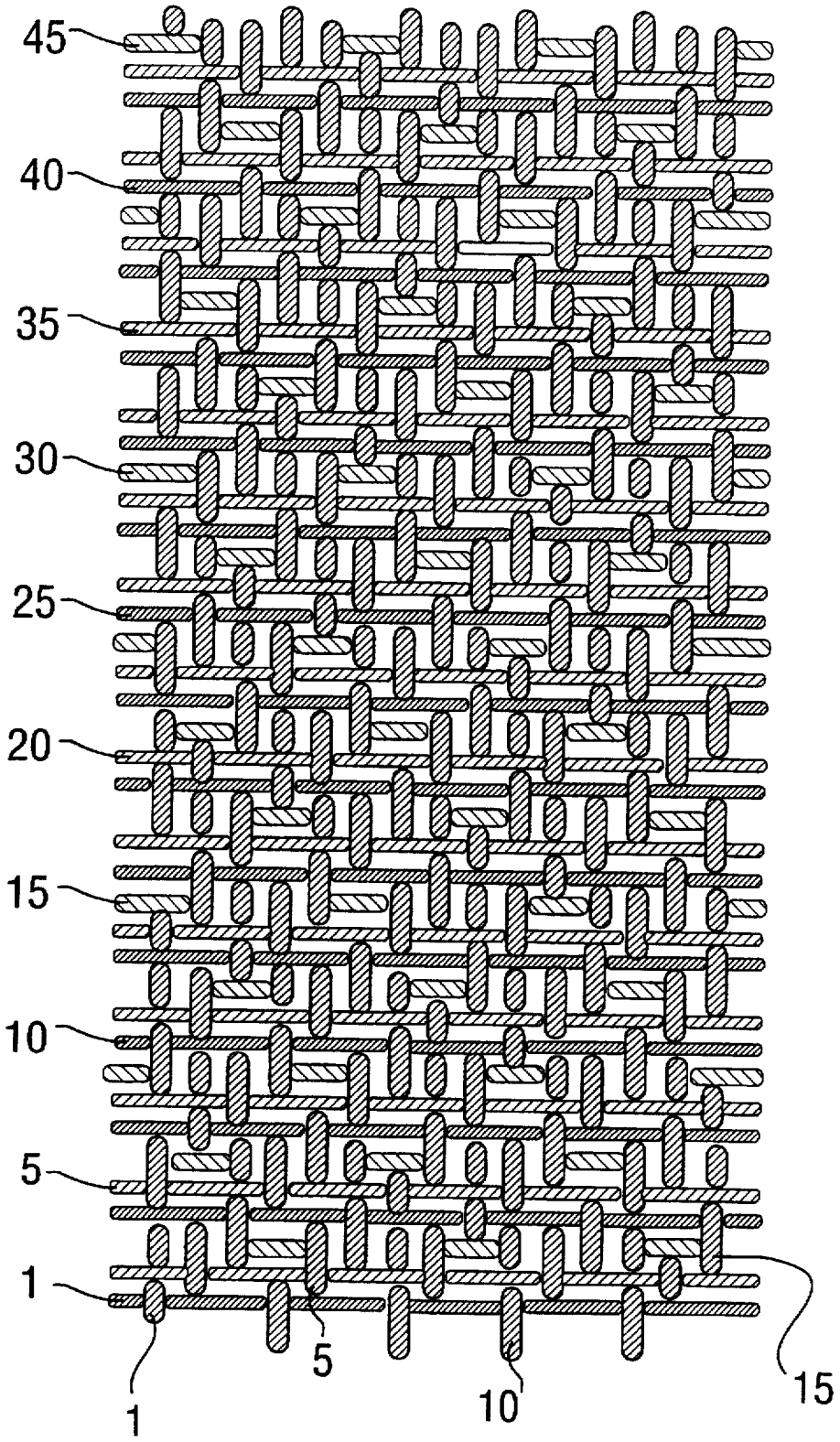
FIG. 11 shows the paper side face of a different 15 shed weave including secondary and tertiary weft yarns.
Figure 12:
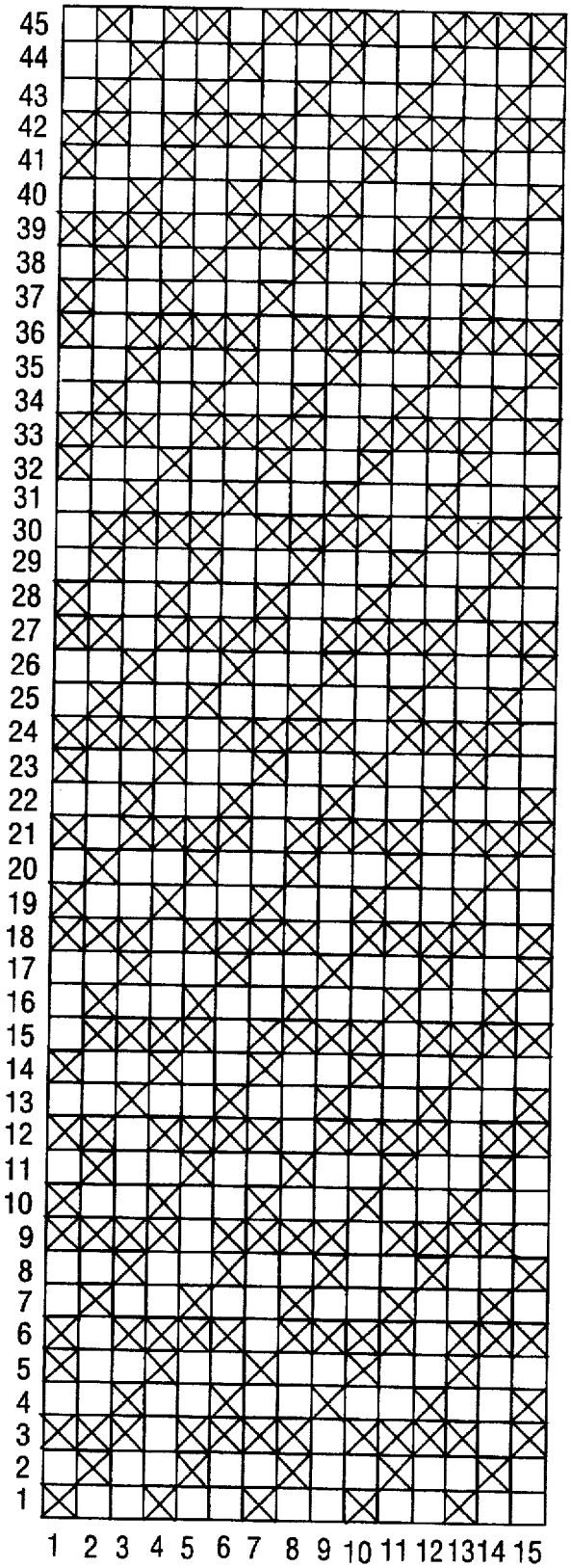
FIG. 12 shows the weave diagram for the fabric of FIG. 11.

In the Figures certain conventions are used. In FIGS. 1, 6 and 11 only the exposed paper side face yarns are shown: where there is a gap in a yarn it is beneath the yarns crossing its path. In FIGS. 5, 10 and 12 an occupied square indicates that the weft is beneath the warp at that point. Where this is done, both warps and wefts, which includes both primary, secondary and tertiary wefts, are numbered sequentially from 1 upwards, usually from the bottom left corner of the Figure.

Referring first to FIGS. 1–5, these show the details of a 12 shed design according to this invention. In these Figures A and D are both 4, B and C are both 3, so that N=4×3=3×4=12.

Figure 2:
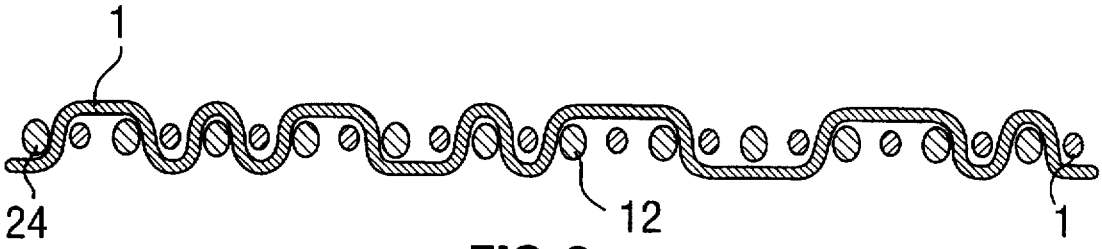
FIG. 2 shows the warp yarn profile for the fabric of FIG. 1.
Figure 3:
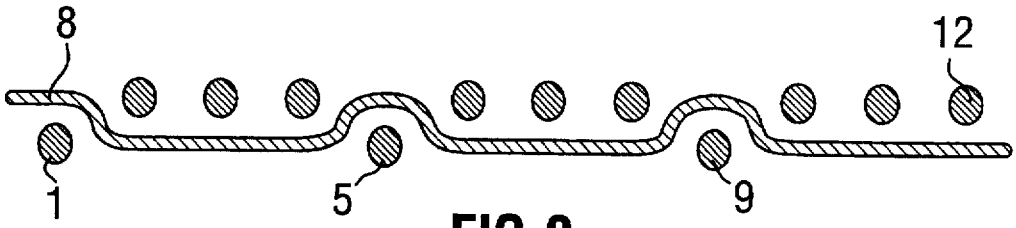
FIGS. 3 and 4 show the weft yarn profiles for the primary and secondary yarns respectively for the fabric of FIG. 1.
Figure 4:
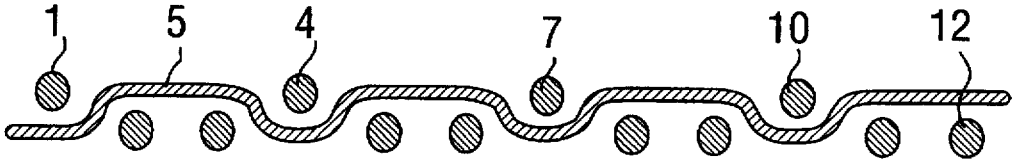

Although the fabric is woven to a repeat pattern, FIG. 1 appears visually to be a somewhat random arrangement. FIG. 2 shows the warp profile in the first pattern for warp 1 in FIG. 1. FIGS. 3 and 4 show the inter-relationship between the second and third weave patterns used for the primary and secondary weft: wefts 8 (primary) and 5 (secondary) from FIG. 1 are shown. FIG. 3 shows the machine side floats in the second weave pattern, and FIG. 4 shows the support provided for the incipient paper web by the third weave pattern. FIG. 5 shows a conventional weave diagram for this fabric.

Figure 7:
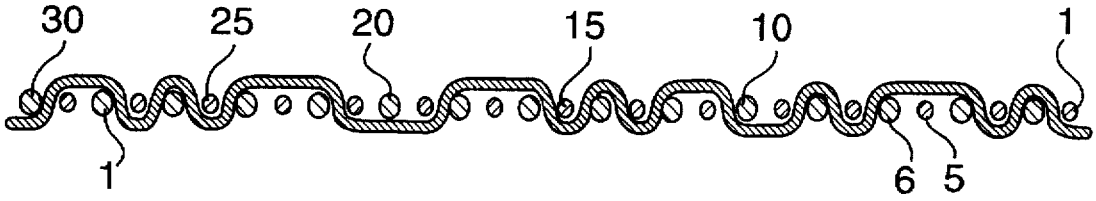
FIG. 7 shows the warp yarn profile for the fabric of FIG. 6.
Figure 8:
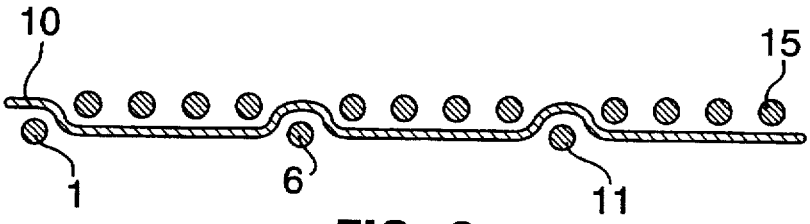
FIGS. 8 and 9 show the weft yarns profiles for the fabric of FIG. 6.
Figure 9:
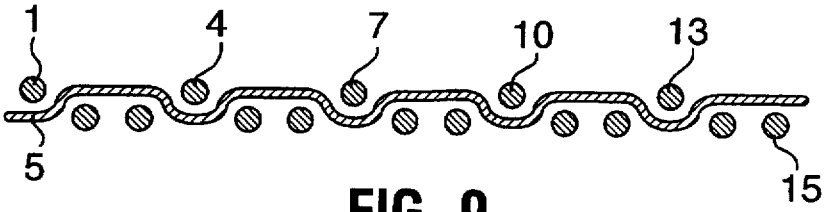

FIGS. 6–10 show similar information for a 15 shed fabric according to the invention. In these Figures A and D are both 5, and B and C are both 3, so that N=5×3=3×5=15. One visual difference between these two fabrics is that the paper side shown in FIG. 6 is much more regular, and lacks the apparent disorganization of FIG. 1. FIG. 7 shows the warp profile within the first pattern for warp 1. FIGS. 8 and 9 show the inter-relationship between the second and third weave patterns used for the primary and secondary weft: wefts 6 (primary) and 5 (secondary) from FIG. 6 are shown. FIG. 8 shows the machine side floats in the second pattern, and FIG. 9 shows the support provided for the incipient paper web by the third pattern. FIG. 10 shows a conventional weave diagram for this fabric.

In FIGS. 1 and 6 the fabric construction includes only one secondary weft in between the primary wefts. FIGS. 11 and 12 show the paper side face and the weave diagram for a fabric similar to FIG. 6, but which includes both secondary and tertiary wefts between each pair of primary wefts. The second pattern for the primary weft is the same as in FIG. 6, and consequently the weft profile is as shown in FIG. 8. Since the third and fourth patterns are the same, the weft profile for the secondary and tertiary wefts is the same as in FIG. 9. As can be seen from FIG. 11 the secondary weft is off set relative to the tertiary weft by one warp. This fabric like FIG. 1 shows a level of apparent disorder in the paper side face shown in FIG. 11.

Fabrics woven according to this invention appear to posses both good drainage characteristics, reduced potential for wire mark, and good releasability as the fabric height is good. It is also found that the frame length is diminished.

As a typical example, the fabric of FIG. 6 can be woven to either of the following specifications:

| | | |
|---|---|---|
| Mesh Count* | 18 × 24 | 38 × 47 |
| Warp Diameter | .35 mm | .17 mm |
| Weft Diameter | | |
| Primary | .35 mm | .17 mm |
| Secondary | .23 mm | .13 mm |

*Mesh count is the number of yarns per centimeter in the woven fabric, expressed as machine direction × cross machine direction.

The fabrics according to this invention can be woven utilising any appropriate yarn. As shown above, the secondary weft yarn is preferably no larger than the primary weft yarn, and more preferably is somewhat smaller. The yarns used can be multifilament spun yarns, braided yarns, or monofilament, of which monofilaments are preferred. When monofilaments are used, the filament cross section can be circular, elliptical, or rectangular. The materials used for the monofilaments can be any suitable thermoplastic, such as polyester, polyamide, and polyester-polyurethane mixtures, which provide the desired properties in the woven fabric.

The fabrics can be woven by any appropriate method. The fabric can be woven flat, as a continuous run, and a suitable length seamed to provide a forming fabric. Alternatively, a circular weaving technique can be used. If a circular weaving technique is used it follows that the yarns referred to above as warps become wefts, and those referred to as wefts become warps. However, the numerical relationships between the first, second, third, and, if present, fourth patterns still apply, and the second pattern still provides cross machine exposed floats.

We claim:

1. A single layer woven papermaker's forming fabric having a machine side and a paper side, comprising warp yarns interlacing with both primary weft yarns and secondary weft yarns in which:

(i) the single layer fabric is woven according to a first repeating pattern in N sheds, (ii) the primary weft yarns are woven with the warp yarns according to a second repeating pattern in A sheds, (iii) a secondary weft yarn is located between any two primary weft yarns, and (iv) the secondary weft yarns are woven with the warp yarns according to a third repeating pattern in C sheds;

wherein:

(a) the second pattern provides at least one machine side cross machine direction exposed primary weft float having a float length Z of at least 3, and A is at least Z+1, (b) the second repeat pattern repeats B times within the N sheds of the first repeat pattern, (c) the third repeat pattern repeats D times within the N sheds of the first repeat pattern, (d) the number of sheds N in the first repeat pattern is at least 10, (e) B and D are different, (f) both B and D are at least 2, and (g) the following relationship exists between A, B, C, D and N: A×B=C×D=N.

2. A fabric according to claim 1 wherein A=Z+1.

3. A fabric according to claim 1 wherein N has a value of from at least 10 to about 50.

4. A fabric according to claim 1 wherein N is at least 12.

5. A fabric according to claim 4 wherein N is 12.

6. A fabric according to claim 4 wherein N is 15.

7. A fabric according to claim 1 wherein the primary weft yarns and the secondary weft yarns are the same size.

8. A fabric according to claim 1 wherein the secondary weft yarns are smaller than the primary weft yarns.

9. A fabric according to claim 1 wherein the second pattern includes one exposed machine side primary weft float.

10. A fabric according to claim 1 wherein Z has a value of from 3 to 10.

11. A single layer woven papermaker's forming fabric having a machine side and a paper side, comprising warp yarns interlacing with both primary weft yarns, secondary weft yarns and tertiary weft yarns in which:

(i) the single layer fabric is woven according a first pattern that repeats once in N sheds, (ii) the primary weft yarns are woven with the warp yarns according to a second pattern that repeats in A sheds, (iii) one secondary weft yarn is located between any two primary weft yarns, (iv) the secondary weft yarns are woven with the warp yarns according to a third pattern that repeats in C sheds, (v) one tertiary weft yarn is located between any chosen pairs of primary weft yarns, (vi) the tertiary weft yarns are woven with the warp yarns according to a fourth pattern that repeats in E sheds, and (vii) the location of the tertiary weft yarns repeats within each repeat of the first pattern;

wherein:

(a) the second pattern provides at least one machine side exposed primary weft float having a float length Z of at least 3, and A is at least Z+1, (b) the second pattern repeats B times within the N sheds of the first pattern, (c) the third pattern repeats D times within the N sheds of the first pattern, (d) the fourth pattern repeats F times within the N sheds of the first pattern, (e) the number of sheds N in the first pattern is at least 10, (f) B is not the same as at least one of D and F, (g) B, D and F are at least 2, and (h) the following relationship exists between A, B, C, D, E, F and N: A×B=C×D=E×F=N.

12. A fabric according to claim 11 wherein A=Z+1.

13. A fabric according to claim 11 wherein N has a value of from at least 10 to about 50.

14. A fabric according to claim 11 wherein N is at least 12.

15. A fabric according to claim 14 wherein N is 12.

16. A fabric according to claim 14 wherein N is 15.

17. A fabric according to claim 11 wherein the primary weft yarns and the secondary weft yarns are the same size.

18. A fabric according to claim 11 wherein the secondary weft yarns are smaller than the primary weft yarns.

19. A fabric according to claim 11 wherein the primary weft yarns and the tertiary weft yarns are the same size.

20. A fabric according to claim 11 wherein the tertiary weft yarns are smaller than the primary weft yarns.

21. A fabric according to claim 11 wherein the secondary weft yarns and the tertiary weft yarns are the same size.

22. A fabric according to claim 11 wherein the secondary weft yarns and the tertiary weft yarns are not the same size.

23. A fabric according to claim 11 wherein there is a tertiary weft yarn between each pair of primary weft yarns.

24. A fabric according to claim 11 wherein there is a secondary weft yarn between some pairs of primary weft yarns, and a secondary weft yarn and a tertiary weft yarn between the remainder of the pairs of primary weft yarns, and the sequence of secondary weft yarns, and of secondary and tertiary weft yarns, between pairs of primary weft yarns repeats within the first pattern.

25. A fabric according to claim 11 wherein the second pattern includes one exposed machine side primary weft float.

26. A fabric according to claim 11 wherein the third and fourth patterns are the same.

27. A fabric according to claim 25 wherein the third and fourth patterns are offset by at least one warp.

28. A fabric according to claim 25 wherein the third and fourth patterns are offset by one warp.

29. A fabric according to claim 11 wherein the third and fourth patterns are not the same.

30. A fabric according to claim 11 wherein Z has a value of from 3 to 10.

* * * * *